United States Patent [19]

Yamaguchi et al.

[11] 3,997,387

[45] Dec. 14, 1976

[54] APPARATUS FOR APPLYING LEADING TIPS TO A CONTINUOUS SHEET MATERIAL AND CUTTING THE SAME

[75] Inventors: Toshiaki Yamaguchi; Katsunori Fujita; Keizo Narita; Takashi Sunda, all of Kyoto, Japan

[73] Assignee: Nishimura Seisakusho Co., Ltd., Kyoto, Japan

[22] Filed: June 5, 1974

[21] Appl. No.: 476,671

[30] Foreign Application Priority Data

June 8, 1973 Japan ..... 48-65229

[52] U.S. Cl. ..... 156/519; 156/271; 156/302; 156/522; 242/56 R

[51] Int. Cl.[2] ..... B65H 19/06; B65H 19/26

[58] Field of Search ..... 156/519, 522, 250, 256, 156/259, 269–271, 297, 302, 361–363, 366, 510, 516; 242/55.2, 55.3, 56 R, 56 A, 56.1, 56.2, 56.6, 56.9

[56] References Cited

UNITED STATES PATENTS

| | | | |
|---|---|---|---|
| 1,196,821 | 9/1916 | Sorgel | 156/522 |
| 2,362,413 | 11/1944 | Shields | 156/522 |
| 2,505,802 | 5/1950 | Stanley | 156/519 |
| 2,527,272 | 10/1950 | Lyon et al. | 156/519 |
| 2,668,023 | 2/1954 | Whitson et al. | 242/56 A |
| 2,948,328 | 8/1960 | Coventry | 156/522 |
| 3,472,462 | 10/1969 | Young | 242/56 R |
| 3,532,573 | 10/1970 | Herman | 242/56.6 |
| 3,784,122 | 1/1974 | Kataoka | 242/56 A |

*Primary Examiner*—William A. Powell
*Assistant Examiner*—John E. Kittle
*Attorney, Agent, or Firm*—Morgan, Finnegan, Pine, Foley & Lee

[57] ABSTRACT

Apparatus for applying leading tips to a continuous sheet material and then cutting the same comprises a rotatable cut drum, a cutting knife contained in the cut drum and adapted to be caused to project outwardly through the surface of said cut drum at a fixed position while said knife is rotating together with the cut drum, a cam mechanism secured to a stationary member outside the cut drum for actuating said cutting knife, a single position clutch adapted to be rotated in synchronism with the cut drum, a mechanism adapted to be driven through said single position clutch for applying leading tips to the continuous sheet material, the arrangement being such that the continuous sheet material is fed along said leading tip applying mechanism and the outer periphery of the cut drum as the cut drum is rotated and that said single position clutch is energized into its connectible condition at predetermined time during the operation, while said cam mechanism is switched to a cammable condition in which it is able to perform its camming action during not more than one complete revolution of cut drum when the continuous sheet material is further transferred a fixed length from the time of application of the leading tip, so that the knife within the cut drum is actuated to cut the sheet material which is running along with the rotation of the cut drum.

9 Claims, 7 Drawing Figures

APPARATUS FOR APPLYING LEADING TIPS TO A CONTINUOUS SHEET MATERIAL AND CUTTING THE SAME

BACKGROUND OF THE INVENTION

This invention relates to apparatus for the production of sheet rolls having leading end tips, and more particularly to apparatus for applying leading tips to a continuous sheet material and cutting the same.

In the production of adhesive tape rolls it is often desired to apply a non-adhesive paper tip to the leading end of each of the adhesive tape rolls. However, it has been heretofore considered extremely difficult to carry out automatically both the cutting of the adhesive tapes and the application of leading paper tips to the cut ends of the adhesive tapes.

The primary object of the invention is to provide an improved apparatus for applying leading tips to a continuous sheet material and cutting the same in which the application of a leading tip to a continuous sheet material and the cutting of the continuous sheet material having the leading tip applied thereon are automatically and successively carried out.

Another object of the invention is to provide an improved apparatus for applying leading tips to a continuous sheet material and cutting the same in which the continuous sheet material having a leading tip thereon is cut exactly along the rear edge of the leading tip.

A further object of the invention is to provide an improved apparatus for the production of rewound rolls of sheet material having leading tips in which the application of leading tips to a continuous sheet material and the cutting of the same can be carried out without interrupting the rewinding apparatus of the continuous sheet material.

A still further object of the invention is to provide an improved apparatus for applying leading tips to a continuous sheet material and cutting the same in which the relative timing relationship between the leading tip applying operation and the cutting operation can be minutely adjusted.

Other objects and advantages of the invention will become apparent from the following detailed description of the invention.

SUMMARY OF THE INVENTION

Apparatus for applying leading tips to a continuous sheet material and cutting the same according to the invention comprises means for continuously feeding said continuous sheet material in the direction of its length at a constant speed from a sheet material supplying position to a sheet material rewinding position through a leading tip applying position and a sheet material cutting position, a rotatable cut drum along a part of which said sheet material is fed, said cut drum being situated at said sheet material cutting position and having a cutting knife which is movable between the first position at which the knife edge of said cutting knife is projected outside of the periphery of said cut drum and the second position at which the knife edge of said cutting knife is retracted inside of the periphery of said cut drum, cam means for actuating said cutting knife between said two positions at a predetermined rotary position of said cut drum within the angle range during which said sheet material is fed in contact with the preiphery of said cut drum, said cam means being movable between an operative position at which said cam means is engageable with said cutting knife and a non-operative position at which said cam means is kept disengaged from said cutting knife, means for switching said cam means from one of said two positions to the other, a drive power source for continuously driving said cut drum for rotation a single position clutch including a driver and a follower which are engageable with each other when they are in a predetermined relative rotation phase relationship, said driver of said single position clutch being operatively connected to said cut drum, means for intermittently applying and adhering leading tips to said continuous sheet material at said leading tip applying position, said leading tip applying and adhering means being operatively connected to said follower of said single position clutch, and timing means for retaining said cam means at its non-operative position for a time during which a predetermined length of said sheet material is fed after each time when said leading tip has been applied and adhered to said sheet material.

The above mentioned cam means may preferably be situated outside of the cut drum and in a fixed position with respect to the rotatable drum having the cutting knife.

In a preferred embodiment of the invention the follower of the single position clutch is operatively connected to leading tip applying means via differential gears so that the relative rotational phase relationship between the follower of the single position clutch and the leading tip applying means may be minutely adjusted as desired.

According to the present invention, since the cutting knife contained in the cut drum is adapted to be driven by cam means which can be switched at a fixed position, it is possible to drive the cutting knife at a fixed angular position when the cut drum is rotated to a fixed rotational position. Further, since leading tip applying means is adapted to be driven by a single position clutch which rotates in synchronism with the rotation of the cut drum, the mutual relation is constant with no danger of involving errors. By adjusting the relative phase by the differential gears, the time the leading tip is applied to a sheet material can be adjusted relative to the rotational position of the cut drum. As a result, the sheet material can be automatically cut at the portion to which the leading tip has been applied. Further, the relation between the position where the leading tip is applied and the position where the sheet material is cut can be mechanically determined by the single position clutch and cam means. Since the film can be cut without interrupting the transfer thereof, the accuracy of the timing interlocking between said two positions can be maintained extremely high.

Thus, according to the present invention, outstanding merits can be achieved, including the automatic and extremely accurate cutting of a continuous sheet material film at the predetermined position of a portion thereof to which leading tape has been applied, and the possibility of designing a continuous winding machine of the full automatic non-stop type.

BRIEF DESCRIPTION OF THE DRAWINGS

For a better understanding of this invention, reference may be made to the accompanying drawings wherein the same reference numerals have been used to denote identical parts.

DETAILED DESCRIPTION OF THE PREFERRED EMBODIMENT OF THE INVENTION

Figure 1:
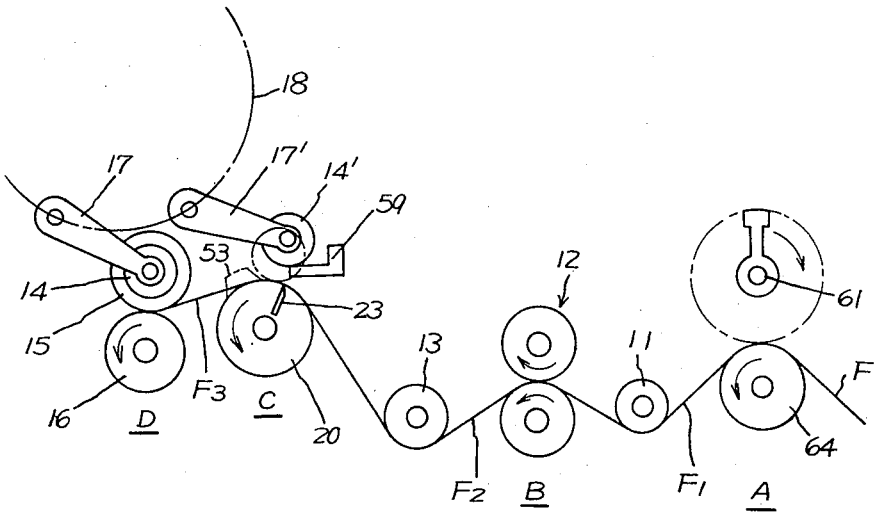
FIG. 1 is a schematic illustration of the roll slitting and rewinding machine embodying the invention.

Referring now to the drawings, particularly to FIG. 1 in which a roll slitting and rewinding machine is schematically illustrated, a continuous film sheet F is supplied from a suitable film supply source such as a film supply roll (not shown) and fed to a leading tip applying position A at which leading tips having a relatively narrow length, e.g., about 0.5 to 5 cm, are intermittently applied and adhered to one of the surfaces of the film sheet F substantially over its whole width in such a manner as hereinafter described in detail. The continuous film sheet F is, by way of example, an adhesive film sheet which comprises a base film sheet and a pressure sensitive adhesive material layer formed on a surface thereof, e.g., on the top surface of the film sheet F illustrated, though the invention may be applied to any other kinds of continuous sheet materials. The film sheet $F_1$ having leading tips adhered thereon is fed through a guide roller 11 to a slitting position B at which the film sheet F is slitted by a slitting mechanism generally indicated by the reference numeral 12 into a plurality of strips $F_2$ which are then fed through a guide roller 13 to a cutting position C at which the strips are cut in the direction of the width in such a manner as hereinafter described in detail. Each of the cut strips $F_3$ is finally rewound by a rewinding core 14 at the rewinding position D. The reference numeral 15 indicates the rewound roll formed on the rewinding core 14. Each of the rewinding cores 14 having a rewound roll 15 formed thereon is rotatably supported by a support arm 17 and driven by a surface drive roller 16. The support arm 16 supports a plurality of rewinding cores 14 which are driven by the respective surface drive rollers 16. A plurality of support arms each supporting a plurality of rewinding cores are arranged on a turn table or turret (not shown) with regular angle intervals. The turn table is movable intermittently for each angle interval so that the rewinding cores supported the respective support arms may be successively placed at the operating position. The reference numeral 18 indicates the trace circle along which the pivotal axles for the support arms travel. In FIG. 1, in addition to the support arm 17 supporting the rewinding cores which are now in the operating condition, there is only illustrated another one support arm 17' supporting a plurality of rewinding cores 14' which are in the next waiting position. In the operating condition, each of the rewinding cores 14 or rewinding rolls 15 formed thereon is always kept in contact with the drive roller 16 by means of suitable biasing means, while rewinding cores 14' at the next waiting position is kept by a stopper 59 apart from the cut drum 20. The surface drive roller 16 is continuously driven at a constant speed. According to the invention, the continuous sheet material is thus fed continuously in the direction of its length at a constant speed from the sheet material supplying position to the rewinding position D through the leading tip applying position A, the slitting position B and the sheet material cutting position C.

At the cutting position C, the slitted strips F is fed in contact with a cut drum 20 for its fixed rotary angle range. As hereinafter described the cut drum 20 is driven by a drive power source for rotation at a constant speed. Accordingly, the cut drum 20 serves as a feed roller for the slitted strips $F_2$.

Figure 4:
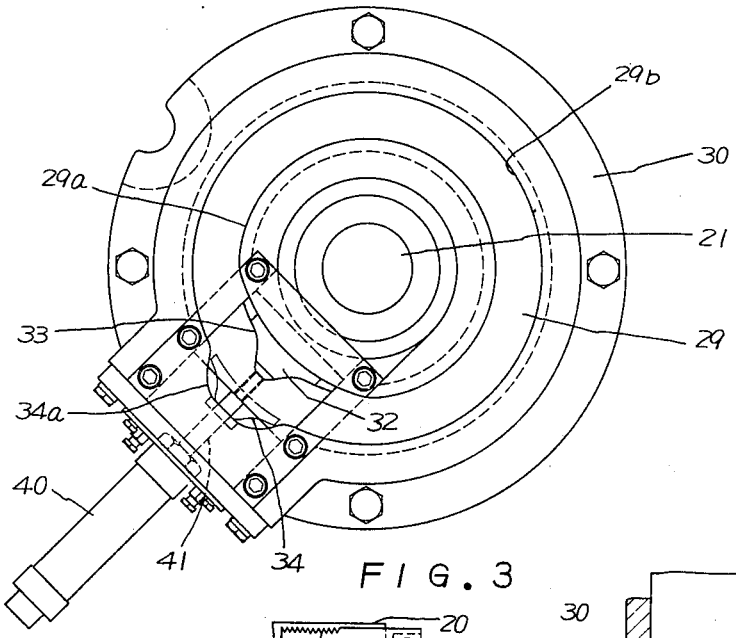
FIG. 4 is a side view of the cam means illustrated in FIG. 3 taken along the lines of 4—4 in FIG. 3.
Figure 3:
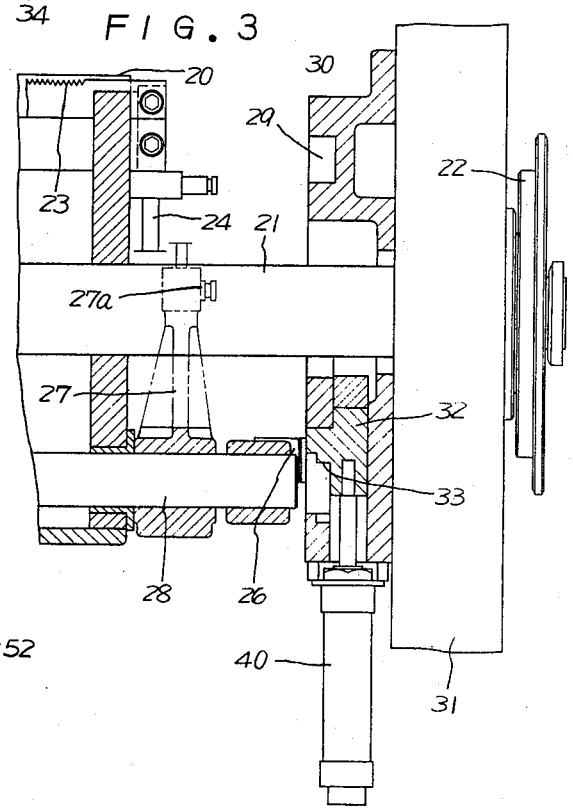
FIG. 3 is a vertical sectional view, partly cut off, of the cutting knife actuating means taken along the lines of 3—3 in FIG. 2.
Figure 2:
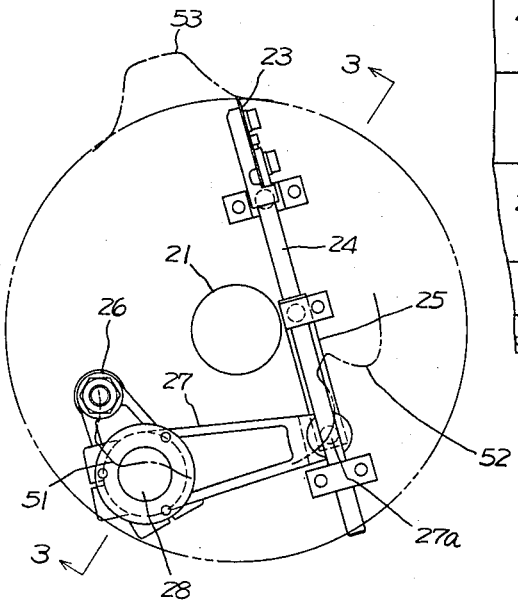
FIG. 2 is a side elevation of the cutting knife and its drive means contained in the cut drum illustrated in FIG. 1.

The construction of the cut drum 20 is illustrated more in detail in FIGS. 2 to 4. The cut drum 20 is fixed on a driven shaft 21 which is connected to and driven by a power drive source through a driven pully 22 fixed on the drive shaft 21. The cut drum 20 has a cutting blade or knife 23 which is laterally extended in a direction parallel to the generating line or the axis of the cut drum 20 throughout about its whole length. The blade 23 is held by a blade holder 24 which is elongated in the direction of an extension of the blade. The blade holder 24 is slidably supported and movable in its elongated direction, which is parallel to a radius of the drum 20, between the two positions; the first position at which the top edge of the blade 23 is projected outside of the periphery of the drum 20 and the second position at which the top edge of the blade 23 is retracted inside of the periphery of the drum 20. The reference numeral 25 indicates guide means for a straight sliding of the blade holder 24.

The blade holder 24 is connected via a lever 27 pivotally supported by a pin 28 to a cam follower 26 which is in turn always engaged with an annular groove 29 formed in a stationary block 30. The reference numeral **27*a* indicates a pin connecting the lever 27 with the blade support 24. The stationary block 30 is mounted on a frame 31 which rotatably carries the drive shaft 21. The stationary block 30 is provided at a fixed position of the annular groove 29 with cam means. Cam means comprises a cam element 32 having an elevated cam periphery 33 and a cam element pocket 34 formed in the outer periphery 35 of the groove 29 at its fixed position. The cam element 32 is movable between an operative position and a non-operative position. At the operative position the cam element 32 engages with the inner periphery 29*a* of the groove 29, the opposite ends of the cam periphery 33 of the cam element merging in the inner periphery 29*a* of the groove 29 so as to define the inner periphery of a completed cam groove while the cam element pocket 34 is opened, the opposite ends of the inner wall 34*a* merging in the outer periphery 29*b* of the groove 29 so as to define the outer periphery of the same completed cam groove. This state is illustrated in solid lines in FIG. 4. At the non-operative position the cam element 32 is entirely retraced within the cam element pocket 34 so that no substantial movement may be given to the cam follower 26 in the groove 29 during the rotation of the drum 20. This non-operative state is illustrated in dot-dash lines in FIG. 4.**

The cam element is actuated by an air cylinder 40 via a connecting rod 41 extending in a radial direction as described hereinafter in detail.

If the cam means is in the operative condition, the knife blade 23 is projected from the periphery of the drum 20 for each rotation of the drum when the cam follower 26 travels the cam periphery 33 of the cam element. Since the cam means is provided at a fixed position of the stationary block 30, the knife blade 23 is projected at a predetermined rotational position of the drum 20. This predetermined position is selected within the rotational angle range during which the slitting strips $F_2$ are fed in contact with the periphery of the cut drum 20. In other words, the slitted strips are cut by knife blade 23 during the time when they are in contact with the periphery of the cut drum 20.

In FIG. 2, the reference numerals 51, 52 and 53 indicate the locations of the cam follower 26, the connecting pin 27*a* and the top edge of the knife blade 23, respectively.

Turning back to FIG. 1 of the drawings, means for intermittently applying and adhering leading tips at the leading tip applying position A may preferably comprise a leading tip holder 61 which is supported by support arms 62 which are in turn mounted on a driver shaft 63. This means is also schematically illustrated in FIG. 5. The holder 61 can hold at its outer end surface, by means of suction or by any other suitable means, a leading paper tip having a relatively small length but a laterally extended width. FIG. 1 illustrates the state in which the holder 61 is in a rest position. If the shaft 63 is driven for rotation, after a 180° rotation the holder 61 holding the leading tip engages the adhesive film sheet F which is in contact with and fed by a cooperating feed roller 64 with the result that the leading tip is transferred and adhered to the adhesive layer of the film sheet F. After another 180° rotation the holder 61 is returned to the initial rest position at which a new leading tip is supplied.

The adhesive film sheet having a paper leading tip thereon must be cut exactly along the rear edge of the leading tip adhered to the adhesive film sheet. According to the invention, in order to achieve this object a single position clutch and a timing or delay means are utilized.

Figure 5:
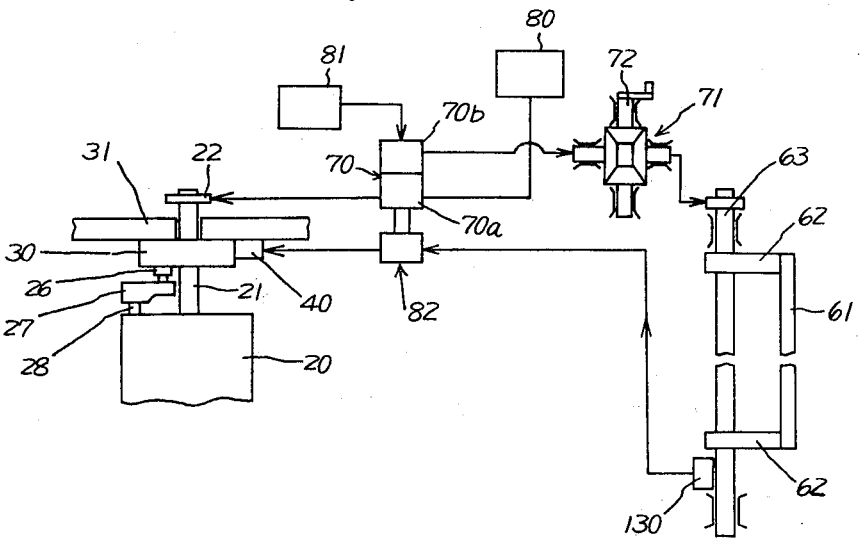
FIG. 5 is a schematic illustration of the interlocking relationship between the cut drum and leading tip applying means illustrated in FIG. 1.

Referring to FIG. 5 in which the interlocking relationship between the cut drum and leading tip applying means is schematically illustrated, a single position clutch is generally indicated as 70. The single position clutch 70 may be of any known type and comprise a driver 70*a* and a follower 70*b* which are engageable with each other when they are in a predetermined relative rotating phase relationship. According to the invention the driver 70*a* of the single position clutch 70 is operatively connected to the rotating shaft 21 of the drim 20 while the follower 70*b* of the single position clutch 70 is operatively connected to the rotating shaft 63 of leading tips applying means through differential gears generally indicated as 71. The driver 70*a* of the single position clutch 70 is driven for rotation at the same speed as that of the rotating shaft of the drum 20. Accordingly, the rotational phase of the driver 70*a* of the single position clutch directly represents the rotational phase of the cut drum 20 having the knife blade 23. When the single position clutch is connected and in operation, the following 70*b* is driven for rotation at the same speed as that of the rotating shaft 63 of leading tip applying means. Accordingly, the rotational phase of the follower 70*b* of the single position clutch 70 can directly represent the rotational phase of the leading tip applying means. In this manner leading tip applying means can be driven in an exactly synchronous relationship with the cut drum 20. Any rotational phase difference between the follower 70*b* of the single position clutch 70 and the rotating shaft 63 for leading tip applying means may be compensated by controlling an adjust shaft 72 included in the differential gears 71.

In FIG. 5 the reference numeral 80 indicates a drive power source for driving both the shaft 21 of the cut drum 20 and the driver 70*a* of the single position clutch 70. The reference numeral 81 indicates means for generating a signal for coupling the single position clutch 70. Accordingly, when an output signal from signal generating means 81 is applied to the single position clutch 70, the follower 70*b* is connected to the driver 70*a* to be driven at the same speed and the driven power is then transmitted to the shaft 63 of leading tip applying means via the differential gears 71 The signal generating means may be operable either manually or automatically. In case of an automatic control, signal generating means may issue output signals with regular time intervals which depend on the length to be wound on the rewound rolls.

It is required that the cutting operation by the knife or blade 23 held by the rotating cut drum 20 must be carried out in such a manner that the slitted strips may be cut along the rear edge of a leading tip adhered on each of the strips. In other words the cutting operation should be carried out at the time when a predetermined length of the material has been fed after the leading tip is applied and adhered to the sheet material F at the leading tip applying position A. In order to achieve this effect timing or delay means are utilized. This timing means is generally indicated as 82 in FIG. 5.

Figure 6:
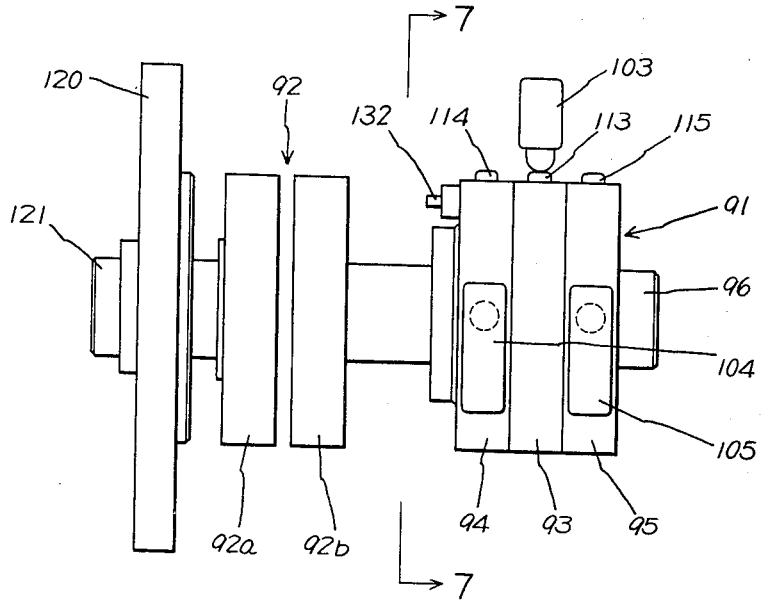
FIG. 6 is a front view of the switch control means included in the timing means illustrated in FIG. 1.
Figure 7:
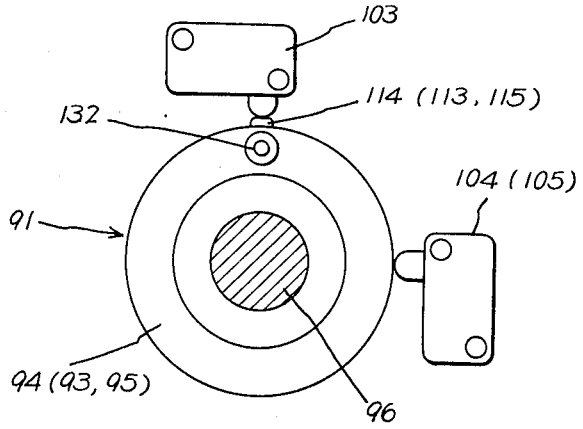
FIG. 7 is a side view of FIG. 6 taken along the lines of 7—7 in FIG. 6.

A preferred embodiment of timing means 82 is illustrated more in detail in FIG. 6 and 7. Timing means 82 may preferably comprise a switch control assembly generally indicated as 91 and an electromagnetic clutch 92. The switch control assembly 91, may preferably comprise three rotatable disks 93, 94 and 95 fixed on a single drive shaft 96 and three microswiches 103, 104 and 105. The three disks 93, 94 and 95 have projections 113, 114 and 115 at their respective peripheries. The projections 113, 114 and 115 are engageable with the microswitches 103, 104 and 105, respectively.

The clutch 92 comprises a driver 92*a* and a follower 92*b* are engageable with each other by an electromagnetic force. The driver 92*a* is connected to the drive power source 80 (FIG. 5) through reduction gears so that it may be driven for continous rotation at a relatively low speed. The reference numeral 120 indicates one of the reduction gears. The gear 120 and the driver 92*a* of the clutch 92 are mounted on the same driven shaft 121. The clutch 92 is coupled by means of an electromagnetic force each time only when a leading tip is applied and adhered to the film sheet at the leading tip applying position A (FIGS. 1 and 5). The time when a leading tip is applied to the film sheet may be detected by a limit microswitch 130 (FIG. 5). The microswitches 103 and 104 control the operation of the air cylinder 40 (FIGS. 3 and 4). If the microswitch 103 is pushed by the cooperating projection 113 the air cylinder operates to place the cam element 32 in the operative position while as soon as the microswitch 104 is pushed by the cooperating projection 114, the air cylinder 40 operates to retract the cam element 32 to its non-operative position. The positions of the microswitches 103 and 104 with respect to the respective cooperative projections 113 and 114 are so selected that the cam element may be maintained in its operative condition for a period not more than one complete rotation of the cut drum and enough to perform one projecting and retracting stroke of the cutting knife.

The microswitch 105 which is operable by the projection 115 serves to deenergize the electromagnet for coupling the clutch 92. The reference numeral 132 indicates brake means for braking the disks 94, 93 and 95 together with the shaft 96 so as to stop them at the initial starting position as soon as the clutch 92 is disconnected.

The operation of the apparatus described in the above with reference to the drawings is as follows:

When a predetermined length of strip is rewound on each of the rewinding cores 14 (FIG. 1), an operation signal is given by the signal producing means 80 (FIG. 5) to the single position clutch 70, whereby the latter is prepared to its connectible condition. Thereafter, when the driver 70*a* of the single position clutch 70 is rotated to a fixed rotational position, or in other words when the cut drum 20, which rotates in operative connection with the driver 70a, is rotated to a fixed rotational position, the follower 70b of said single position clutch 70 is connected to the driver 70a and rotated together. The torque transmitted through the differential gears 71 rotates the leading tip applicator bar 61 together with the rotary shaft 63 thereof in a clockwise direction as viewed in FIG. 1 to apply a paper leading tip to the adhesive film sheet F between said bar and the outer surface of the applicator roller 64. In addition, during this time also, the roller 64, the drum 20 and the surface drive roller 16 are being rotated without interruption, so that the adhesive film sheet F continues to be moved toward the rewinding position D and rewound on the respective cores 14.

Upon application of the leading tip to the film sheet F, which is detected by the microswitch 131, the electromagnetic clutch 92 is connected as described before so that the switch control members 93, 94 and 95, all fixed on the shaft of the follower 92*b* of the clutch 92, initiate to rotate in a counterclockwise direction in FIG. 7 from a predetermined initial starting position. When the switch control members are rotated through a preset angle, that is, when the cut drum 20 is rotated by a preset number of revolution so that the portion of the film F having the leading tip applied thereto is transferred to a predetermined position adjacent to the cut drum 20 a signal is issued by the microswitch 103 to the air cylinder 40 (FIGS. 3 and 4) so that the cam element 32 is switched by the operation of the air cylinder 40 to its operative position in the annular groove 29. Then, immediately before the knife blade 23 begins to actually project above the outer periphery of the drum 20, the stopper 59 is disengaged from the next core 14′ to allow the latter to be pressed against the outer periphery of the cut drum 20 to take up the new end of the strip thereat. Therefore, after the cam element 32 is switched to its operative condition, when the cut drum 20 is rotated to a fixed rotational position, or in other words when the cam follower 26 travels along the cam element 32 in the groove 29, the cutting knife blade 23 projects at a fixed angular position on the outer periphery of the cut drum 20 between the cores 14 on the cut drum 20 and the cores 14 in the rewinding position D to cut the adhesive tapes therebetween.

If the phase of the follower 70b of the single position clutch 70 relative to the leading tip applicator bar 61 is adjusted in advance as by the differential gears 14, it is possible to arrange so as to rotate the applicator bar 61 when the cut drum 20 takes a suitable rotational position. In other words, the time the leading tip is applied in the application position A can be adjusted relative to the rotational position of the cut drum 20, so that when the cut drum 20 is further rotated to a fixed rotational position and the cutting knife blade 23 projects at an angular position shown in chain lines 53 after the cam element 32 is switched to its operative position by a signal issued from said fed length detecting mechanism 81, the portion of the adhesive film having the leading tip applied thereto can be transferred to the projecting position of the cutting knife blade shown in said chain lines 53. That is, the adhesive film F can be automatically cut at the accurate rear end position of the leading tip applied to the portion of said adhesive film F. Further, since this cutting position can be mechanically determined by the single position clutch 70 and cam mechanism 32, there is no error. In addition, during this cutting operation the rollers 64, 20 and 16, of course, continue to rotate without interruption so that the adhesive film F continues to be transferred. Therefore, there is no danger of errors, which would otherwise occurs due to inertia and slip, taking place at the cutting position of said film.

When the adhesive tapes are cut by the cutting knife blade 23, the termiinal ends thereof are wound on the respective cores 14 in the rewinding position D till the leading tip applied portion, while the initial ends are automatically rewound on the next cores 4′ surface-driven in operative connection with the rotation of the cut drum 20. The turn table having said arms 17 and 17′ mounted thereon is rotated rotted through a fixed angle so that the cores 14′ having said tapes wound thereon are transferred to the rewinding position D while being surface driven in operative connection with the rotation of the cut drum 20 and continue to rewind the adhesive tapes in place of said cores 14.

What we claim is:

1. An apparatus for applying leading tips to, slitting into strips, and cutting a continuous sheet of material, comprising:

means for continuously feeding said continuous sheet in the direction of its length at a constant speed, from a sheet material supplying position, through a leading tip applying position, a sheet slitting position and a slitted strip cutting position, to a slitted strip rewinding position, said sheet slitting position being between said leading tip applying position and said slitted strip cutting position;

tip applying means for intermittently applying and adhering leading tips to said continuous sheet of material substantially over the entire width of said continuous sheet at said leading tip applying position;

slitting means for slitting said continuous sheet with said leading tips adhered thereon into a plurality of slitted strips, at said sheet slitting position;

a rotatable cut drum along a part of which said slitted strips are fed, said cut drum being situated at said sheet material cutting position and having cutting means slidably mounted therein, said cutting means including a knife edge movable between a first position at which said knife edge extends beyond the periphery of said cut drum and a second position at which said knife edge is retracted within the periphery of said cut drum;

cam means for actuating said cutting means between said two positions at a predetermined rotary position of said cut drum within the angle range during which said slitted strips are in contact with the periphery of said cut drum, said cam means being movable between an operative position at which said cam means is engageable with said cutting means to move said cutting means to said first position and a non-operative position at which said cam means is disengaged from said cutting means to maintain said cutting means in said second position;

means for switching said cam means between said operative position and said non-operative position;

drive means for continuously rotating said cut drum;

a single position clutch including a driver and a follower which are engageable with each other when they are in a predetermined relative rotating phase;

means for operably connecting said driver of said single position clutch to said cut drum;

means for operably connecting said follower of said single position clutch to said tip applying means signal generating means for coupling said follower and said driver of said single position clutch to drive said tip applying means when a leading tip is to be applied to said continuous sheet of material; and timing means for retaining said cam means at its non-operative position for a time interval after the application of each of said leading tips, during which a predetermined length of said sheet material is fed over said cut drum and for actuating said cam means to the operative position at the end of said time interval such that said sheet is cut by said cutting means substantially adjacent each of said heating tips along its rear edge.

2. An apparatus according to claim 1 wherein said cam means comprises a cam element positioned outside of said cut drum in a substantially fixed orientation with respect to the rotation of said cut drum and a cam follower mounted to said drum for engaging said cam element when said cam element is in its operative position.

3. An apparatus according to claim 2 wherein said means for switching said cam means comprises a connecting rod to which is affixed said cam element and which is slidably mounted in an air cylinder rigidly affixed to a stationary block, said stationary block being formed with an essentially annular groove having a radially inner circumferential peripheral wall and a radially outer circumferential peripheral wall such that said cam element is movable in said annular groove between said operative position substantially adjacent said inner wall for engagement with said cam follower and said non-operative position substantially adjacent said outer wall.

4. An apparatus according to claim 1 wherein said means for operably connecting said driver to said cut drum comprises differential gear means including adjustment means for adjusting the relative rotational phase difference between said follower and said tip applying means such that said tip applying means and said cut drum are maintained in substantially synchronous rotating relationship.

5. An apparatus according to claim 1 wherein said timing means comprises:

detecting means on said tip applying means for both detecting each time of occurrence when a leading tip has been applied to said continuous sheet and generating a signal at said time;

an electromagnetic clutch energized by said signal, said electromagnetic clutch including a driver operably connected to said drive means and a follower; and switch control means operably connected to the follower of said electromagnetic clutch, said switch control means controlling said cam means such that when a signal is generated by said detecting means, the driver and the follower of said electromagnetic clutch are coupled to activate said switch control means for moving said cam means from said non-operative position to said operative position whereby said slitting strips are cut by said cutting means, and back to said non-operative position after said material has been cut by said cutting means.

6. An apparatus according to claim 5 wherein said switch control means comprises:

first, second and third micro-switches;

first, second and third disks mounted on a shaft operably connected to the follower of said electromagnetic clutch, each disk being formed with a projection for tripping its corresponding micro-switch; and brake means, such that said first micro-switch is activated by the projection on said first disk to move said cam means to the operative position, said second micro-switch is activated by the projection on said second disk to move said cam means to the non-operative position after said cutting means have cut said slitted strips, said third micro-switch is activated by the projection on said third disk to de-activate said electromagnetic clutch, and, said brake means stops rotation of said disks at an initial starting position after said electromagnetic clutch has been de-activated.

7. An apparatus according to claim 1 which further comprises:

a turret at said rewinding position;

stopper means;

a plurality of rewinding cores rotatably mounted to said turret, one of said rewinding cores being in a rewinding operating position for rewinding said slitted strips and a next adjacent rewinding core being retained in a waiting position by said stopper means; and a surface drive roller rotating of a substantially constant speed in contact with said rewinding core in the rewinding position for continuously rotating said rewinding core in the rewinding position, such that when said one rewinding core has been fully rewound with said slitted strips, it is replaced in the rewinding operating position by said next adjacent rewinding core which is adjacent a third rewinding core retained in the waiting position by said stopper means. d

8. An apparatus according to claim 7 which further comprises a plurality of support arms pivotally mounted to said turret, extending generally outwardly of its center, the number of said support arms being equal to the number of said rewinding cores, such that each of said rewinding cores is rotatably mounted to said turret by one of said support arms.

9. An apparatus according to claim 1 wherein:

said means for continuously feeding said continuous sheet at a constant speed includes a feed roller said continuous sheet at a constant speed includes a feed roller at said leading tip applying position essentially adjacent said tip applying means and a surface drive roller in contact with the outer circumferential area of a rewinding core upon which said slitted strips are rewound; and said tip applying means comprises a leading tip holder rigidly mounted to a leading tip drive shaft which is operably connected to the follower of said single position clutch such that said leading tip holder is rotated to contact said feed roller for applying said adhering said leading tip to said continuous sheet; and said apparatus further including a first guide roller positioned between said feed roller and said slitting means for guiding said continuous sheet therebetween and a second guide roller positioned between said slitting means and said cut drum to guide said slitted strips therebetween.

* * * * *